US010320130B2

(12) United States Patent
Xu

(10) Patent No.: US 10,320,130 B2
(45) Date of Patent: Jun. 11, 2019

(54) BARREL TERMINAL

(71) Applicant: LOTES CO., LTD, Keelung (TW)

(72) Inventor: Lu Xu, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/681,665

(22) Filed: Aug. 21, 2017

(65) Prior Publication Data

US 2018/0212370 A1 Jul. 26, 2018

(30) Foreign Application Priority Data

Jan. 20, 2017 (CN) ..... 2017 2 0114080 U

(51) Int. Cl.

| | |
|---|---|
| ***H01R 13/68*** | (2011.01) |
| ***H01R 13/703*** | (2006.01) |
| ***H01R 13/66*** | (2006.01) |
| ***H01R 24/58*** | (2011.01) |
| ***H01R 13/11*** | (2006.01) |
| *H01R 4/02* | (2006.01) |
| *H01R 4/18* | (2006.01) |
| *H01R 43/16* | (2006.01) |

(52) U.S. Cl.

CPC ..... *H01R 13/7033* (2013.01); *H01R 13/111* (2013.01); *H01R 13/665* (2013.01); *H01R 24/58* (2013.01); *H01R 4/023* (2013.01); *H01R 4/183* (2013.01); *H01R 43/16* (2013.01)

(58) Field of Classification Search

CPC ..... H01R 13/7033; H01R 13/111; H01R 13/665; H01R 24/58; H01R 4/023; H01R 4/183; H01R 43/16

USPC ..... 439/620.29, 851–854

See application file for complete search history.

(56) References Cited

U.S. PATENT DOCUMENTS

| | | | | |
|---|---|---|---|---|
| 4,010,539 | A | 3/1977 | Iantorno | |
| 4,076,355 | A | 2/1978 | Olsson et al. | |
| 4,585,295 | A | 4/1986 | Ackerman | |
| 8,079,885 | B1 * | 12/2011 | Lin | H01R 13/111 439/851 |

(Continued)

FOREIGN PATENT DOCUMENTS

| | | |
|---|---|---|
| CN | 1145539 A | 3/1997 |
| CN | 1672297 A | 9/2005 |

(Continued)

*Primary Examiner* — Khiem M Nguyen

(74) *Attorney, Agent, or Firm* — Locke Lord LLP; Tim Tingkang Xia, Esq.

(57) ABSTRACT

A barrel terminal has one end for inserting a mating member and the other end for connecting a cable. The barrel terminal includes a contact portion, a connecting portion, and a buffer portion connecting the contact portion and the connecting portion. The contact portion has multiple contact elastic pieces, and the contact elastic pieces are used for electrically contacting the mating member. The connecting portion is used for connecting the cable. The buffer portion has multiple absorption portions. The absorption portions absorb the deformation stress of the connecting portion to prevent the stress from being transferred to the contact portion, to avoid the deformation of the contact elastic pieces, so as not to cause the reduction of the contact area between the contact elastic pieces and the abutment terminal, and to prevent reduction of a clamping force of the barrel terminal to the mating member.

11 Claims, 9 Drawing Sheets

(56) References Cited

U.S. PATENT DOCUMENTS 8,632,356 B2 * 1/2014 Bihrer ..... H01R 13/18
439/442

FOREIGN PATENT DOCUMENTS

| | | | |
|---|---|---|---|
| CN | 101409398 | A | 4/2009 |
| CN | 201773948 | U | 3/2011 |
| CN | 103022771 | A | 4/2013 |

* cited by examiner

BARREL TERMINAL

CROSS-REFERENCE TO RELATED APPLICATION

This non-provisional application claims priority to and benefit of, under 35 U.S.C. § 119(a), Patent Application No. 201720114080.2 filed in P.R. China on Jan. 20, 2017, the entire content of which is hereby incorporated by reference.

FIELD OF THE INVENTION

The present invention relates generally to a barrel terminal, and more particularly to a barrel terminal that is capable of absorbing deformation stress.

BACKGROUND OF THE INVENTION

It is known that a barrel terminal capable of allowing a large current to pass through has a contact portion and a connecting portion which are interconnected. The contact portion has multiple fence-shaped elastic pieces distributed circumferentially. A mating member is inserted into the barrel terminal in parallel from one side of the barrel terminal and elastically contacts the elastic pieces of the contact portion. A cable is inserted into the barrel terminal from the other side of the barrel terminal. The tube wall of the connecting portion covers the cable, and the cable and the connecting portion can be fixedly connected with each other in a riveting manner or in a soldering manner, so that the electric connection between the mating member and the cable is realized by means of the transmission of the barrel terminal.

Although the design that the contact portion has multiple elastic pieces can meet the requirements on the electric conductivity and heat dissipation performance of the terminal, the elastic pieces are very likely to deform. When the connecting portion and the cable are riveted or soldered, the connecting portion is deformed to generate the deformation stress, the surplus stress is transferred from the connecting portion to the contact portion, the structure of the elastic pieces is deformed, resulting in the reduction of a contact area between the elastic pieces and the mating member and the reduction of a clamping force of the elastic pieces to the mating member, so that the elastic contact between the elastic pieces and the mating member is unstable.

Therefore, a heretofore unaddressed need exists in the art to address the aforementioned deficiencies and inadequacies.

SUMMARY OF THE INVENTION

In one aspect, the present invention relates to a large-current barrel terminal that achieves objectives of absorbing the deformation stress of a connecting portion by means of a buffer portion and protecting a contact portion against the damage of the deformation stress.

In certain embodiments, a barrel terminal has one end for a mating member to be inserted therein and the other end for electrical connection with a cable. The barrel terminal includes a contact portion, a connecting portion and a buffer portion. The contact portion has multiple contact elastic pieces, and each contact elastic piece has elasticity and is used for electrically contacting the mating member. The connecting portion is used to connect the cable. The buffer portion connects the contact portion and the connecting portion. The buffering portion has multiple absorption portions, and the absorption portions absorb the deformation stress of the connecting portion.

In certain embodiments, the multiple absorption portions are longitudinally arranged at intervals and uniformly distributed.

In certain embodiments, the absorption portions are of elastic piece structures.

In certain embodiments, the multiple absorption portions are encircled to form a buffer cavity.

In certain embodiments, the buffer cavity has a central axis, and a distance from each of the absorption portions to the central axis is equal.

In certain embodiments, the buffer cavity has a central axis, and the distance from each of the absorption portions to the central axis is gradually reduced along an insertion direction of the mating member.

In certain embodiments, the multiple contact elastic pieces are encircled to form a contact cavity, the contact cavity is communicated with the buffer cavity, and the contact cavity is used for the mating member to be inserted therein.

In certain embodiments, the connecting portion has a connection cavity, the connection cavity is used for the cable to enter, and the connection cavity, the buffer cavity and the contact cavity are communicated with one another.

In certain embodiments, the connection cavity has a first cavity and a second cavity which are communicated with each other, the first cavity is disposed between the buffer cavity and the second cavity, and the buffer cavity, the first cavity and the second cavity are communicated with one another.

In certain embodiments, a diameter of the first cavity is identical to a minimum diameter of the buffer cavity, and the diameter of the first cavity is smaller than a diameter of the second cavity.

In certain embodiments, the cable is fixedly connected with the connecting portion in a riveting manner or soldering manner.

Compared with the related art, one end of the barrel terminal is used for inserting an mating member, the other end is used for connecting a cable, and the barrel terminal includes a contact portion, a connecting portion, and a buffer portion. The contact portion has multiple contact elastic pieces, and the contact elastic pieces are used for electrically contacting the mating member. The connecting portion is used for connecting the cable. The buffer portion connects the contact portion and the connecting portion. The buffer portion has multiple absorption portions, the absorption portions absorb the deformation stress of the connecting portion to prevent the stress from being transferred to the contact portion and to avoid the deformation of the contact elastic pieces, so as not to cause the reduction of the contact area between the contact elastic pieces and the mating terminal, thereby further preventing the deformation from causing the reduction of a clamping force of the barrel terminal to the mating member and from causing the unstable electrical connection of the barrel terminal and the mating member and the poor electric conductivity.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
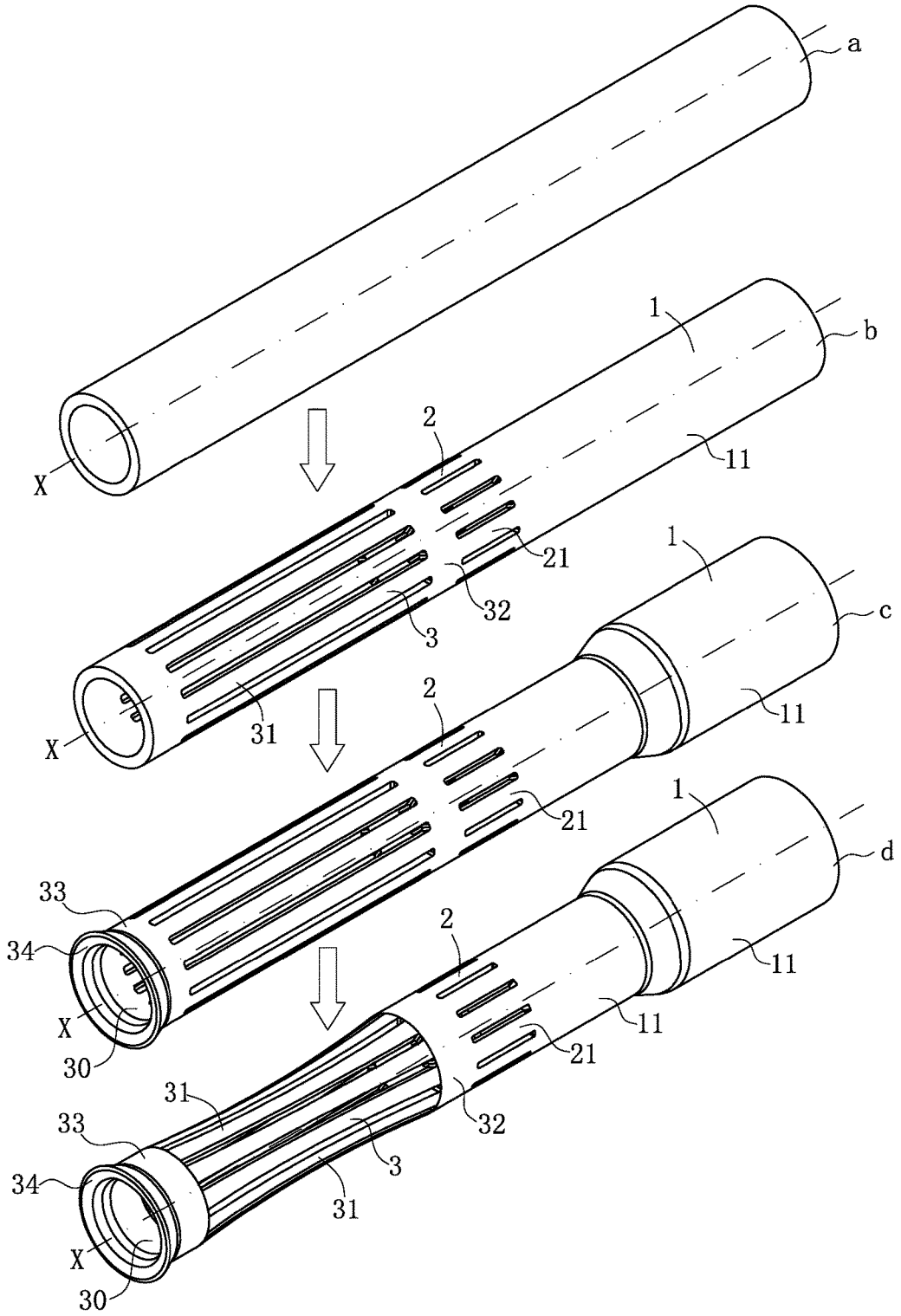
FIG. 1 is a schematic three-dimensional view illustrating molding steps of a barrel terminal according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to a barrel terminal.

Figure 2:
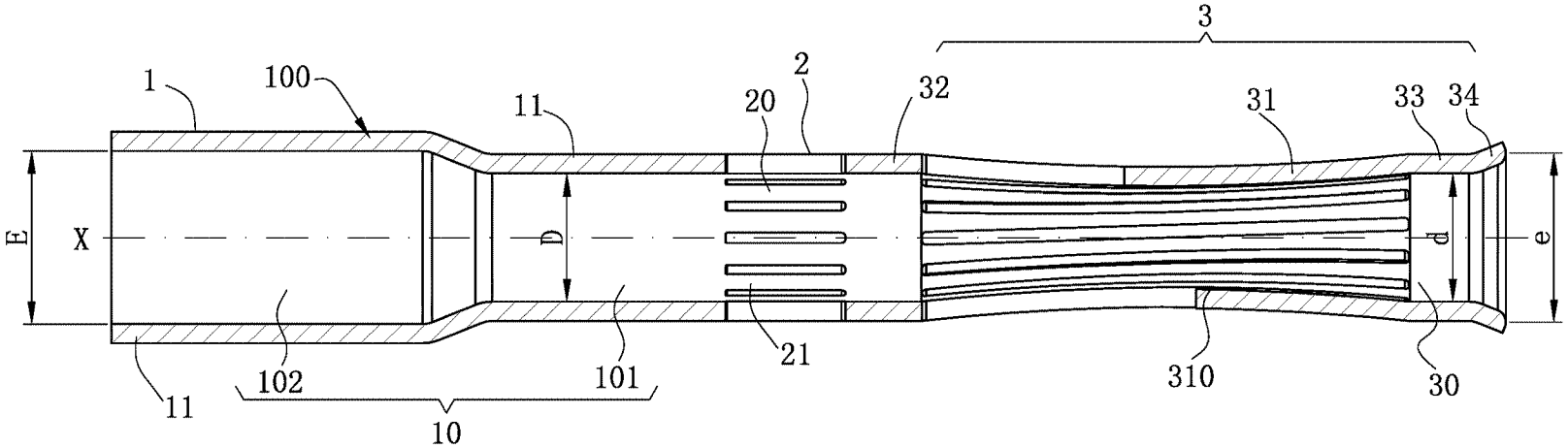
FIG. 2 is a sectional plane view of FIG. 1 before the barrel terminal is fixedly connected with a cable.
Figure 3:
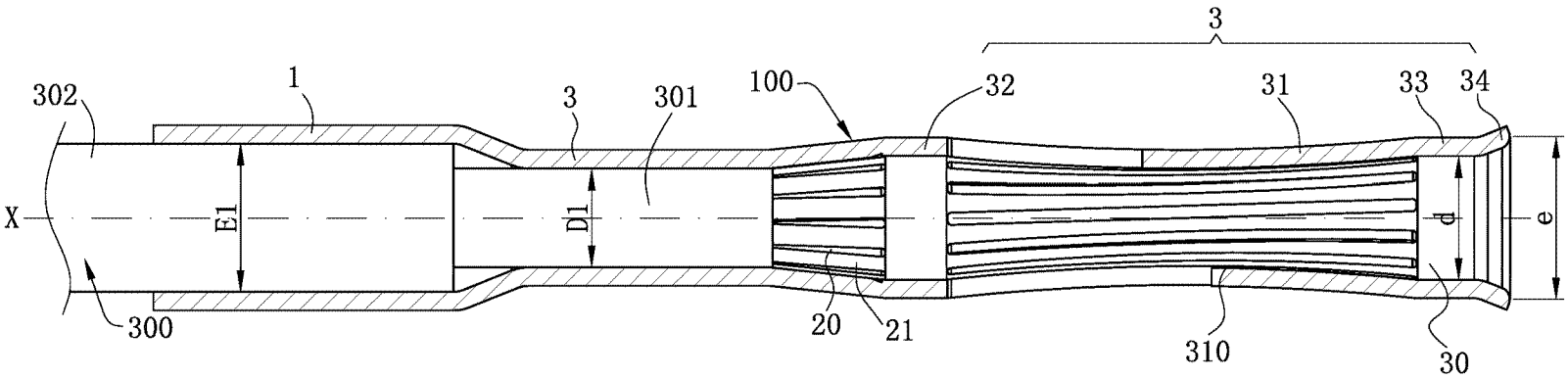
FIG. 3 is a sectional plane view of FIG. 1 after the barrel terminal is fixedly connected with the cable.
Figure 4:
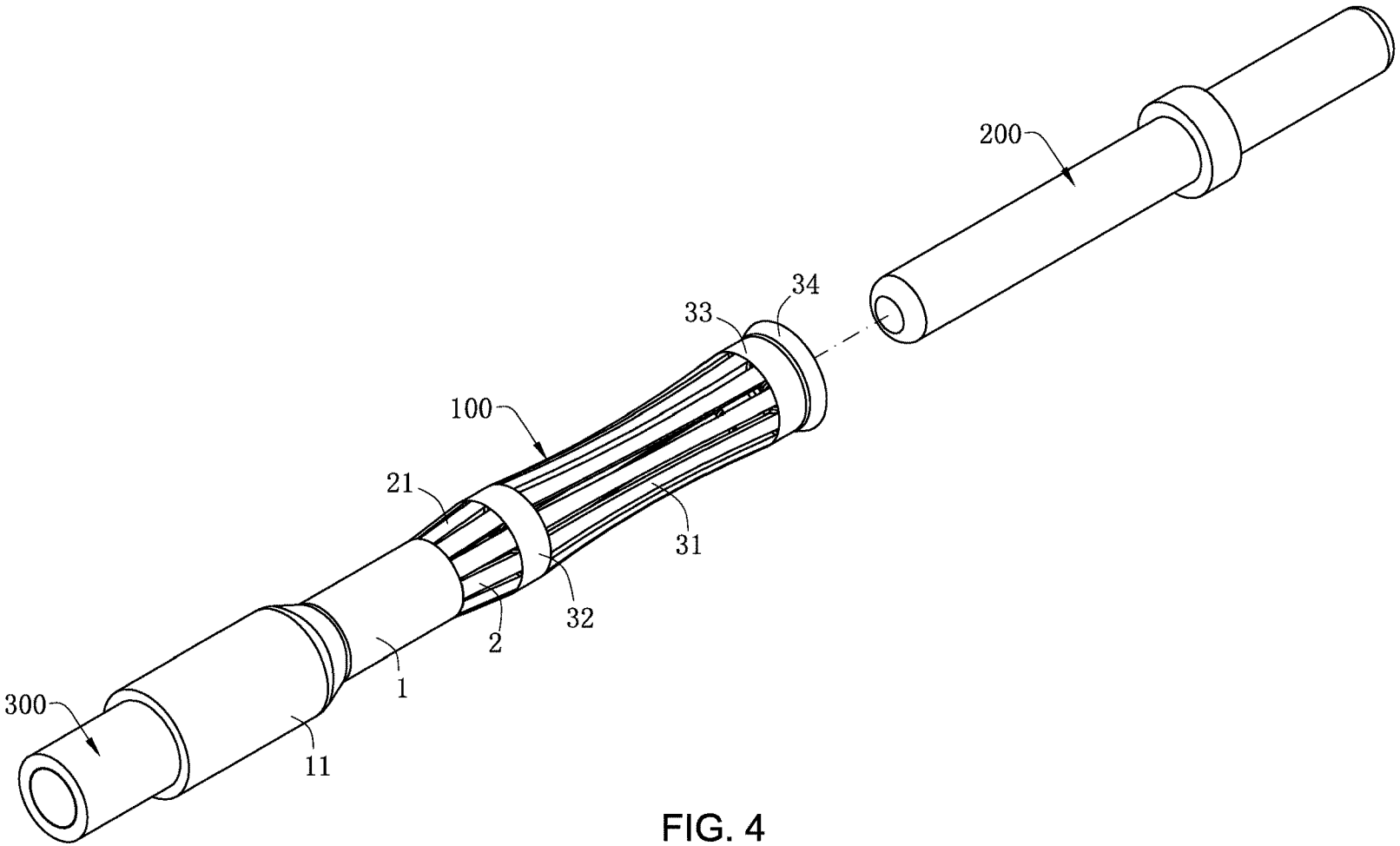
FIG. 4 is a schematic three-dimensional view of FIG. 1 after the barrel terminal is connected with the cable and not engaged with a mating member.

FIGS. 1-6 show a first embodiment of the present invention. Referring to FIGS. 1, 2 and 4, a barrel terminal 100 is formed by a cylindrical barrel with openings at two ends thereof. The barrel terminal 100 has a central axis X. As shown in step a of FIG. 1, one end of the barrel terminal 100 is used for an mating member 200 to be inserted therein, and the other end is connected with a cable 300. The barrel terminal 100 includes a connecting portion 1 for connecting the cable 300, a contact portion 3 for the mating member 200 to be inserted therein, and a buffer portion 2 connecting the connecting portion 1 and the contact portion 3.

Referring to FIGS. 1-3, the connecting portion 1 has a tube wall 11. The tube wall 11 is encircled along the central axis X to form a connection cavity 10. The tail end of the tube wall 11 is radially expanded, as shown in step c of FIG. 1, so that the connection cavity 10 has a first cavity 101 and a second cavity 102 which are connected with each other. The first cavity 101 is disposed between the second cavity 102 and the buffer portion 2. The buffer portion 2, the first cavity 101 and the second cavity 102 are communicated with one another. A diameter D of the first cavity 101 is smaller than a diameter E of the second cavity 102. The cable 300 is inserted into the connection cavity 10. The cable 300 has an insulation portion 301 and a core portion 302. The insulation portion 301 is correspondingly arranged at the first cavity 101, and the core portion 302 is correspondingly arranged at the second cavity 102.

Referring to FIGS. 2-4, the buffer portion 2 has multiple absorption portions 21. The multiple absorption portions 21 are formed by cutting the cylindrical wall of the cylindrical barrel at intervals. As shown in step b of FIG. 1, in the present invention, the absorption portions 21 are of elastic piece structures. The absorption portions 21 are encircled along the central axis X to form a buffer cavity 20. A diameter of the buffer cavity 20 is equal to the diameter D of the first cavity. The buffer cavity 20 is communicated with the connection cavity 10, thus facilitating the heat dissipation of the barrel terminal 100. The buffer cavity 20 supplies a buffer deformation space to the absorption portions 21. When the connecting portion 1 is not deformed, the distance from each of the absorption portions 21 to the central axis X is equal, as shown in FIG. 2. After the connecting portion 1 is deformed, the distance from each of the absorption portions 21 to the central axis X is gradually reduced along the axial direction, as shown in FIG. 3. One end of each absorption portion 21 is connected with the connecting portion 1, and the other end is connected with the contact portion 3, so that the structure is compact, and the absorption portions 21 conveniently absorb the deformation stress of the connecting portion 1.

Figure 5:
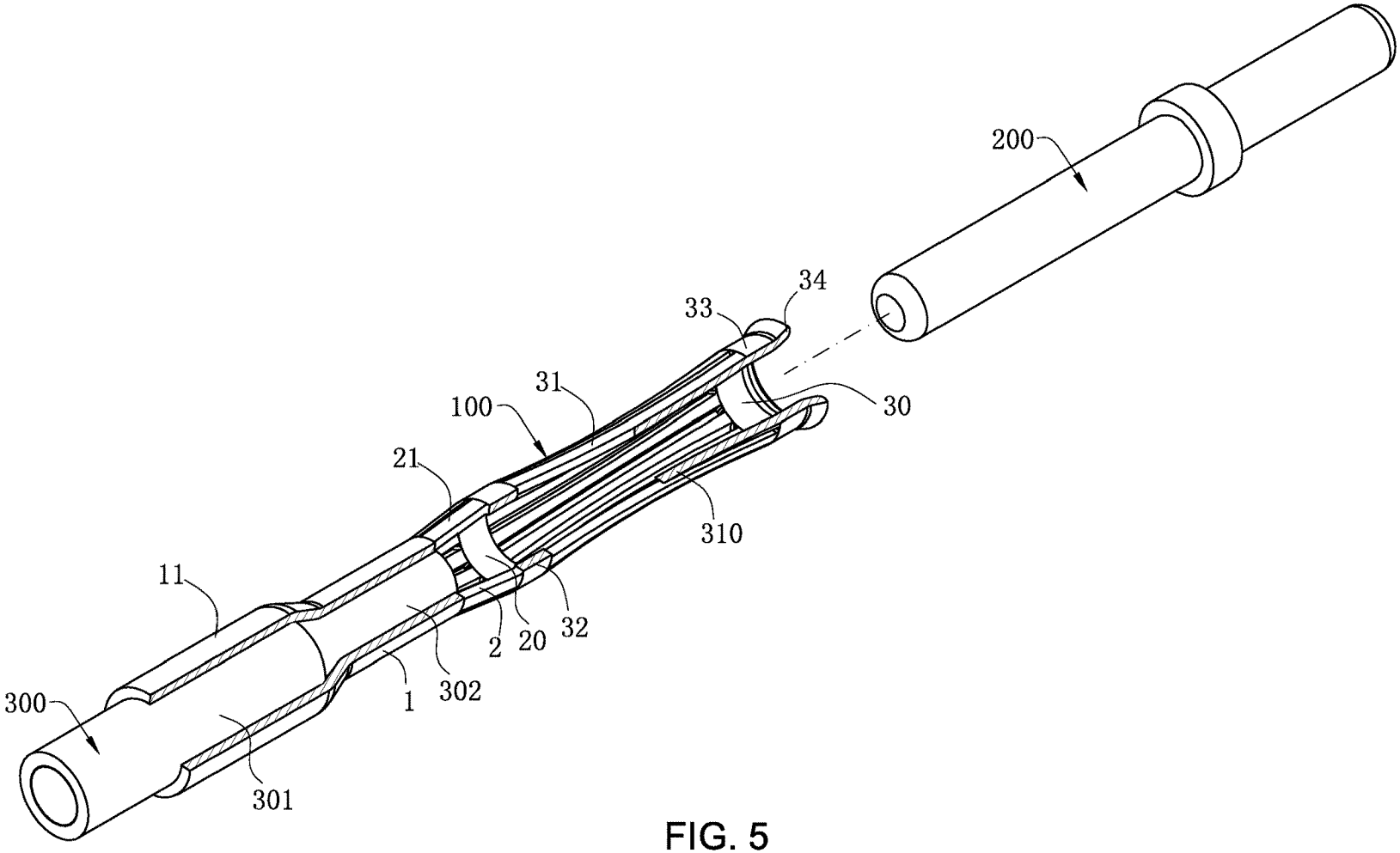
FIG. 5 is a schematic three-dimensional cross-sectional view of FIG. 1 after the barrel terminal is connected with the cable and not cooperated with the mating member.
Figure 6:
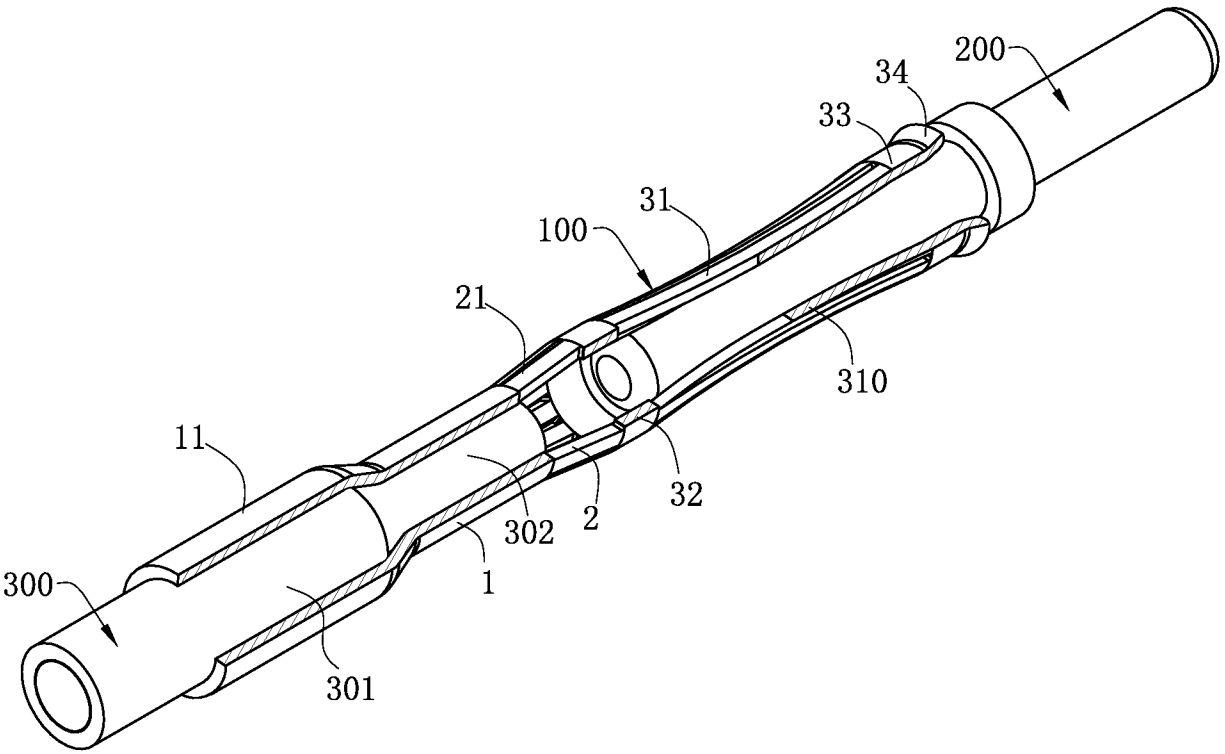
FIG. 6 is a schematic three-dimensional cross-sectional view of FIG. 1 after the barrel terminal is connected with the cable and engaged with the mating member.

Referring to FIGS. 1, 5 and 6, the contact portion 3 has a contact cavity 30 and multiple contact elastic pieces 31. The multiple contact elastic pieces 31 are formed by cutting the tube wall of the cylindrical barrel at intervals. As shown in step b of FIG. 1, the multiple contact elastic pieces 31 are encircled along the central axis X to form the contact cavity 30. The contact cavity 30 is communicated with the buffer cavity 20, and the contact cavity 30 is communicated with the connection cavity 10 through the buffer cavity 20, so that the heat dissipation performance of the barrel terminal 100 is good. Meanwhile, the contact elastic pieces 31 are twisted relative to the central axis X, so that the contact elastic pieces 31 incline along the central axis X, the middle positions of the contact elastic pieces 31 are arched toward the contact cavity 30 relative to two ends, and the contact elastic pieces 31 are arranged in an arc shape, as shown in step d of FIG. 1. The middle position of each contact elastic piece 31 is a contact point 310. The mating member 200 is inserted into the contact cavity 30 in parallel from one side of the barrel terminal 100 and electrically contacts the contact point 310. Multiple contact points 310 form multi-point contact with the mating member 200 to increase the contact area between the contact elastic pieces 31 and the mating member 200, so that the electric contact between the barrel terminal 100 and the mating member 200 is good. Meanwhile, the contact elastic pieces 31 have a good clamping force to the mating member 200, the electrical connection between the barrel terminal 100 and the mating member 200 is firm, and the electric contact is good. The contact portion 3 further has a front end ring 32 and a rear end ring 33. The front end ring 32 and the rear end ring 33 are disposed at two ends of the contact elastic pieces 31 and surround the contact cavity 30 along the central axis X. The front end ring 32 is disposed at one end, which is close to the buffer portion 2, of the contact elastic piece 31, and the rear end ring 33 is disposed at one end, which is away from the buffer portion 2, of the contact elastic piece 31. An open end of the rear end ring 33 is radially expanded outward to form a flared opening 34, as shown in step c of FIG. 1. The diameter d of the rear end ring 32 is smaller than the diameter e of the flared opening 34, thereby playing a role in guiding the insertion of the mating member 200, and further facilitating the insertion of the mating member 200.

Referring to FIGS. 2, 3 and 5, the connecting portion 1 is fixedly connected with the cable 300 in a riveting manner. The cable 300 is inserted into the connection cavity 10, and the tube wall 11 covers the cable 300. When the tube wall 11 is compressed by using a crimping tool, the tube wall 11 is deformed toward the connection cavity 10. The diameter of the first cavity is changed from D to D1, the diameter of the second cavity is changed from E to E1, where D1 is smaller than D, E1 is smaller than E, and D1 is smaller than E1. The tube wall 11 compresses the cable 300, and the tube wall 11 is fixedly connected with the cable 300 in a crimping manner to form the electric connection. The tube wall 11 is deformed to generate deformation stress, the absorption portions 21 absorb the deformation stress of the tube wall 11 and are deformed toward the buffer cavity 20. The closer the absorption portions 21 to the connecting portion 1, the more deformation stress may be absorbed, the greater the deformation towards the buffer cavity 20 is, and the smaller the distance to the central axis X is, so that the distance from each of the absorption portions 21 to the central axis X is reduced along the insertion direction of the mating member 200, the diameter of the buffer cavity 20 is reduced along the insertion direction of the mating member 200, and the minimum diameter of the buffer cavity 20 is equal to the diameter D1 of the first cavity. Since the absorption portions 21 absorb the deformation stress of the connecting portion 1, the elastic structure of the contact portion 3 is protected, the reduction of the contact area and the clamping force between the contact elastic pieces 31 and the mating member 200 caused by the deformation of the contact elastic pieces 31 can be avoided, and the unfavorable electric contact caused by the reduction of the contact area and the reduction of the clamping force can be further avoided.

Figure 7:
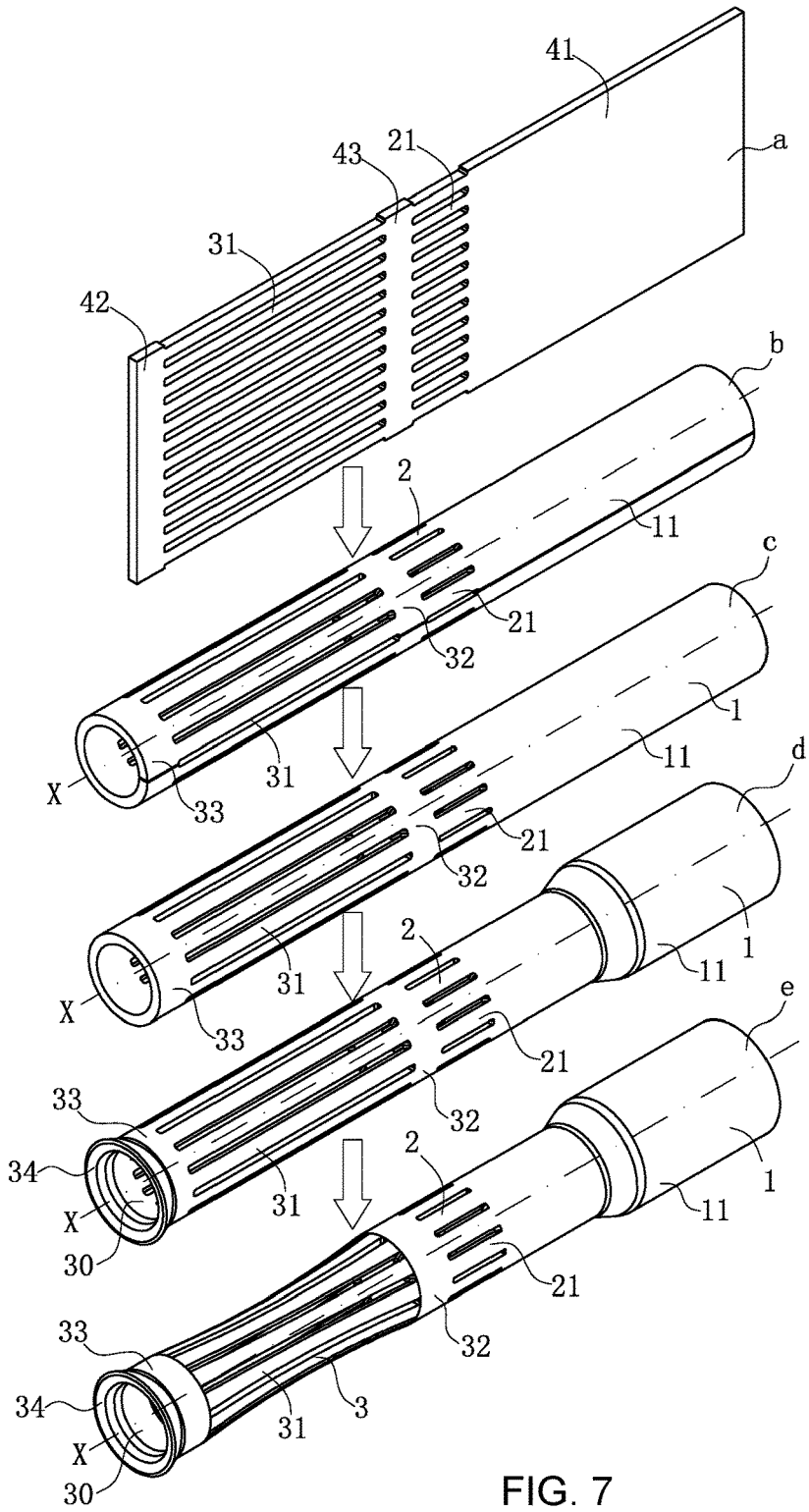
FIG. 7 is a schematic three-dimensional view illustrating molding steps of a barrel terminal according to a second embodiment of the present invention.

FIG. 7 shows a second embodiment of the present invention. As shown in FIG. 7, a barrel terminal 100 is a barrel body formed by curling a metal sheet with good electric conductivity. Referring to step a of FIG. 7, an expanded view of a metal sheet before the barrel terminal 100 is molded is shown. Multiple fence-shaped absorption portions 21 and multiple contact elastic pieces 31, which are uniformly distributed, are directly punched on the metal sheet. A large end bar 41 and a small end bar 42 are formed at two ends of the metal sheet, and a spacing bar 43 is provided between the absorption portions 21 and the contact elastic pieces 31. The spacing bar 43 is connected with the large end bar 41 through the absorption portions 21, and the small end bar 42 is connected with the spacing bar 43 through the contact elastic pieces 21. Referring to step b of FIG. 7, the metal sheet is curled to form the barrel body with a gap. The barrel body has a central axis X. The large end bar 41 is curled to form the tube wall 11 which is encircled to form the connection cavity 10, the absorption portions 21 are curled to form the buffer cavity 20, and the contact elastic pieces 31 are curled to form the contact cavity 30. The connection cavity 10, the buffer cavity 20 and the contact cavity 30 are communicated with one another. The spacing bar 43 is curled to form the front end ring 32, and the small end bar 42 is curled to form the rear end ring 33. Referring to step c of FIG. 7, the barrel body is soldered in a solder seam. Referring to step d of FIG. 7, an open end of the tube wall 11 is radially expanded outward, so that the connection cavity 10 forms a first cavity 101 and a second cavity 102 which are connected with each other, and the open end of the rear end ring 33 is radially expanded outward to form a flared opening 34. Referring to step e of FIG. 7, the contact elastic pieces 31 are twisted along the central axis X, so that the contact elastic pieces 31 incline along the central axis X, the middle position of each contact elastic piece 31 is arched towards the contact cavity 30 relative to the two ends, and the contact elastic pieces 31 are arranged in an arc shape. The middle position of each contact elastic piece 31 is a contact point 310, and the mating member 200 is inserted into the contact cavity 30 in parallel from one side of the barrel terminal 100 and electrically contacts the contact point 310.

Figure 8:
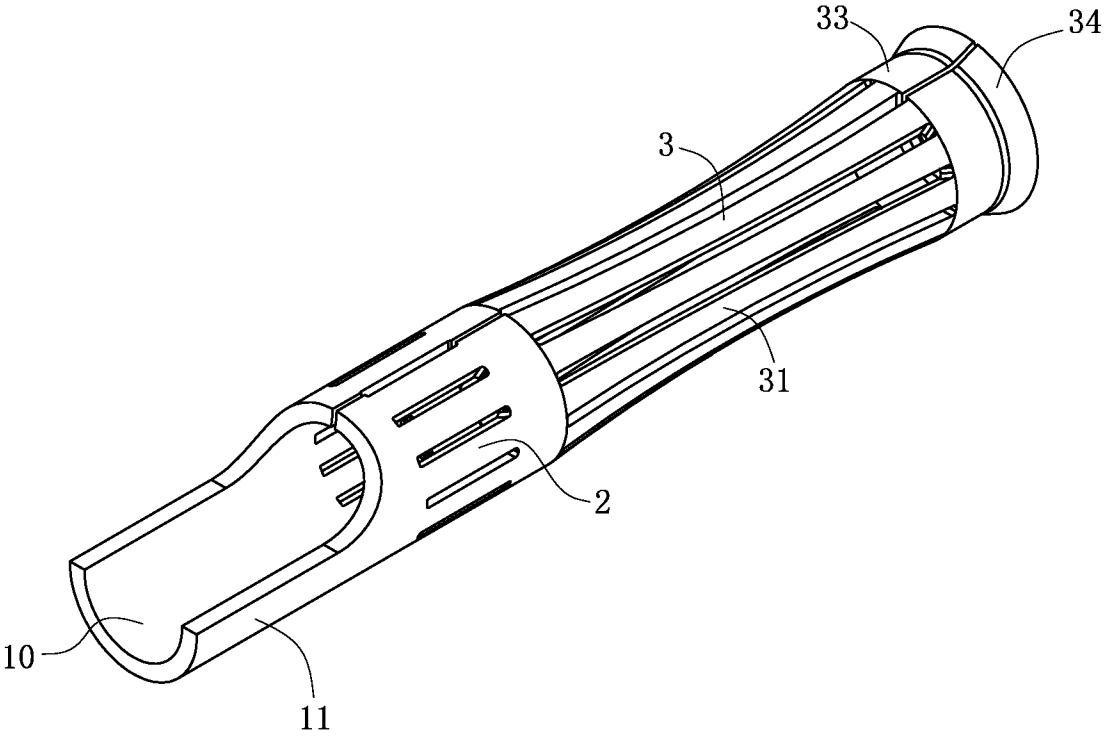
FIG. 8 is a schematic three-dimensional view of a barrel terminal according to a third embodiment of the present invention.
Figure 9:
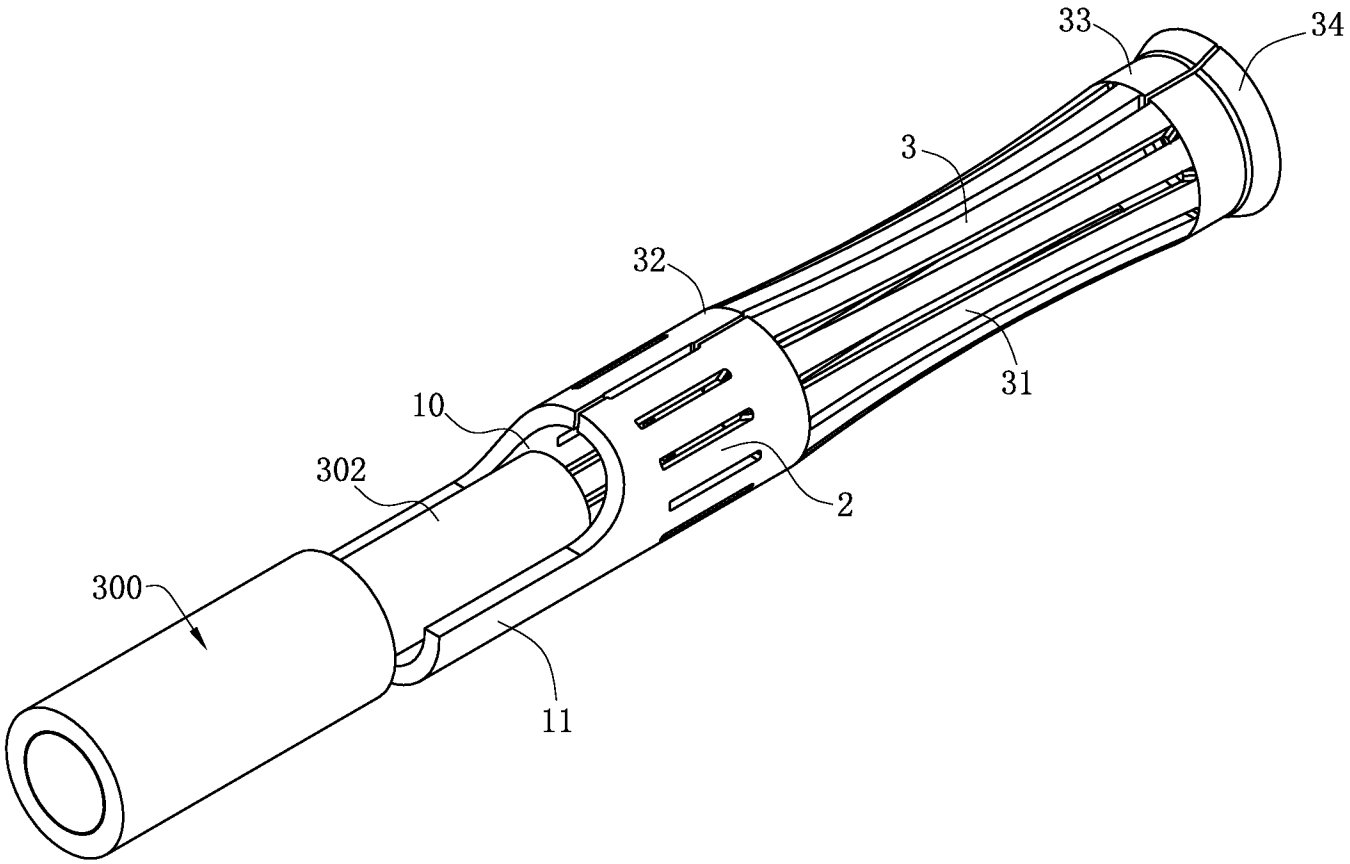
FIG. 9 is a schematic three-dimensional view illustrating the engagement of the barrel terminal and the cable in FIG. 8.

FIGS. 8 and 9 show a third embodiment of the present invention. As shown in FIGS. 8 and 9, the connecting portion 1 has a connection cavity 10 and a tube wall 11 incompletely covering the connection cavity 10. The cable 300 has a core portion 302. The core portion 302 is inserted into the connection cavity 10 and fixedly soldered to the tube wall 11. The cable 300 is electrically connected with the barrel terminal 100. The buffer portion 2 absorbs the deformation stress generated by the soldering of the connecting portion, and the stress is prevented from being transferred to the contact portion 3.

In summary, the barrel terminal according to certain embodiments of the present invention has the following beneficial advantages:

1. The barrel terminal 100 has a buffer portion 2, the buffer portion has multiple absorption portions 21, and the multiple absorption portions 21 are encircled along the central axis X to form a buffer cavity 20. When the absorption portions 21 absorb the deformation stress of the connecting portion 1, the absorption portions 21 are deformed toward the buffer cavity 20, and the buffer cavity 20 supplies a buffer deformation space to the absorption portions 21. The buffer portion 2 absorbs the deformation stress of the connecting portion 1, so that the stress cannot be transferred to the contact portion 3, the elastic structure of the contact portion 3 is protected, the reduction of the contact area and the clamping force between the contact elastic pieces 31 and the mating member 200 caused by the deformation of the contact elastic pieces 31 is avoided, and the unstable electric connection between the barrel terminal 100 and the mating member 200 caused by the reduction of the contact area and the reduction of the clamping force can be further avoided.

2. The distance from each absorption portion 21 to the central axis X is equal, so that the buffer portion 2 can uniformly absorb the deformation stress of the connecting portion 1, and the stress absorbed by the buffer portion 2 is prevented from being concentrated at one point.

3. The contact portion 3 has multiple contact elastic pieces 31, and the middle position of each contact elastic piece 31 is arched toward the contact cavity 30 relative to the two ends. The middle position of each contact elastic piece 31 is a contact point 310, and the mating member 200 is inserted into the barrel terminal 100 and electrically contacts the contact point 310. The multiple contact points 310 increase the contact area between the barrel terminal 100 and the mating member 200, and the contact points 310 are arched towards the contact cavity 30 and elastically contact the mating member 200, so that the clamping force of the barrel terminal 100 to the mating member 200 is increased, and the electric connection between the barrel terminal 100 and the mating member 200 is good.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A barrel terminal, having one end for an mating member to be inserted therein and the other end for electrically connecting a cable, and the barrel terminal comprising:

a contact portion having a plurality of contact elastic pieces, wherein the contact elastic pieces have elasticity and are used for electrically contacting the mating member;

a connecting portion for connecting the cable; and a buffer portion connecting the contact portion and the connecting portion, wherein the buffer portion has a plurality of absorption portions, each of the absorption portions is not in contact with the mating member, and the absorption portions are configured to absorb a deformation stress of the connecting portion.

2. The barrel terminal of claim 1, wherein the absorption portions are longitudinally arranged at intervals and uniformly distributed.

3. The barrel terminal of claim 1, wherein the absorption portions are of elastic piece structures.

4. The barrel terminal of claim 1, wherein the absorption portions are encircled to form a buffer cavity.

5. The barrel terminal of claim 4, wherein the buffer cavity has a central axis, and a distance from each of the absorption portions to the central axis is equal.

6. The barrel terminal of claim 4, wherein the buffer cavity has a central axis, and a distance from each of the absorption portions to the central axis is reduced along an insertion direction of the mating member.

7. The barrel terminal of claim 4, wherein the contact elastic pieces are encircled to form a contact cavity, the contact cavity is communicated with the buffer cavity, and the contact cavity is used for the mating member to be inserted therein.

8. The barrel terminal of claim 7, wherein the connecting portion has a connection cavity, the connection cavity is used for the cable to enter, and the connection cavity, the buffer cavity and the contact cavity are communicated with one another.

9. The barrel terminal of claim 8, wherein the connection cavity has a first cavity and a second cavity communicated with each other, the first cavity is disposed between the buffer cavity and the second cavity, and the buffer cavity, the first cavity and the second cavity are communicated with one another.

10. The barrel terminal of claim 9, wherein a diameter of the first cavity is identical to a minimum diameter of the buffer cavity, and the diameter of the first cavity is smaller than a diameter of the second cavity.

11. The barrel terminal of claim 1, wherein the cable is fixedly connected with the connecting portion in a riveting manner or in a soldering manner.

* * * * *